US005642832A

United States Patent [19]

Favre

[11] Patent Number: 5,642,832

[45] Date of Patent: Jul. 1, 1997

[54] CASE WITH HINGED CLOSURE THAT ASSISTS OPENING

[75] Inventor: Bernard Favre, Chevilly-Larue, France

[73] Assignee: LIR France, Chevilly-Larue, France

[21] Appl. No.: 545,098

[22] Filed: Oct. 19, 1995

[30] Foreign Application Priority Data

Oct. 19, 1994 [FR] France ..... 94 12476

[51] Int. Cl.[6] ..... B65D 43/16

[52] U.S. Cl. ..... 220/260; 206/581; 206/823; 220/335

[58] Field of Search ..... 206/581, 235, 206/823; 220/4.21, 4.22, 4.23, DIG. 26, 260, 335; 132/293, 315

[56] References Cited

U.S. PATENT DOCUMENTS

| | | | |
|---|---|---|---|
| 1,709,182 | 4/1929 | McKnight et al. | 220/DIG. 26 X |
| 4,454,889 | 6/1984 | Contreras, Sr. | 206/581 X |
| 4,685,558 | 8/1987 | Filiz et al. | 206/1.5 |
| 4,858,765 | 8/1989 | Nakamura et al. . | |
| 4,860,920 | 8/1989 | Quennessen | 206/581 X |
| 4,863,034 | 9/1989 | Contreras, Sr. | 206/581 |
| 5,205,431 | 4/1993 | Zinnbauer | 206/581 X |
| 5,232,001 | 8/1993 | Machelett | 206/823 X |
| 5,331,982 | 7/1994 | Machelett | 206/581 X |

FOREIGN PATENT DOCUMENTS

| | | |
|---|---|---|
| 0 570 298 | 11/1993 | European Pat. Off. . |
| 0 570 299 | 11/1993 | European Pat. Off. . |
| 2 546 137 | 11/1984 | France . |
| 2 689 100 | 10/1993 | France . |

*Primary Examiner*—Jimmy G. Foster
*Attorney, Agent, or Firm*—Young & Thompson

[57] ABSTRACT

A case such as a cosmetic case has a base and a lid hinged on the edge of the base. Adjacent the hinge (4) of the case (1), the base (2) has at least one flexible tongue (8) of limited elasticity. The lid (3) has, facing that tongue (8), at least one rigid protuberance (6), such that during closure of the case (1), the protuberance (6) of the lid (3) will come into abutment against the flexible tongue (8) of the base (2). The limited elasticity of the flexible tongue (8) ensures that closure of the lid on the base will be stopped whilst not yet complete, thereby to leave a small gap between the lid and the base into which the fingernail can be inserted to reopen the case.

5 Claims, 2 Drawing Sheets

CASE WITH HINGED CLOSURE THAT ASSISTS OPENING

FIELD OF THE INVENTION

The invention relates to a case, particularly for cosmetic products, of the type comprising a base and a cover hinged on the edge of the base and having a hinged closure that assists opening.

BACKGROUND OF THE INVENTION

Known cases of this type have closure means disposed at the hinge, known per se, and which, particularly, cause on the one hand the lowering of the lid on the base and the maintenance of the lid in open position relative to the base. However, for cases of this type, the opening of the case often gives rise to difficulties to the extent that the user must have at least the possibility, in order to open it, of inserting for example a fingernail in the plane of the joint between the lid and the base, opposite the hinge of the case.

There is known from FR-A-2 689 100, a case which comprises at the hinge axis, hinge pins that are elastically deformable between a closed position of the case in which the hinge rod is subjected to distortion and an open position in which the distortion is released. On the rear portion of the base of the case, there is then a projection which, coming into abutment with the lid during closure, presses the lid rearwardly, thereby giving rise to the deformation of the hinge pins.

According to certain modifications, the projection is mounted on a flexible tongue and contributes to reinforcing the pivotal effect of the lid when the distortion of the hinge pins is relaxed.

However, even though there is obtained assistance to the opening of the case, this embodiment remains complicated and costly because it requires a particular embodiment of the bores in which the hinge pins deform. Moreover, there must be used hinge pins of an elastically deformable material. Most of the time, because of the distortion of the hinge pins, there arises the risk of permanent deformation of the pins and a loss of opening assistance.

SUMMARY OF THE INVENTION

To overcome these drawbacks, the invention provides creation of a small gap between the base and the lid of the case when the case is in closed position. This small gap must be sufficiently thin to prevent any untimely opening of the case when no particular force is applied thereto, whilst being sufficient to permit inserting a fingernail during opening and this in a simple manner.

The present invention provides a new case of the mentioned type in which a small gap is provided between the lid and the base by creating elastic resistance at the hinge between the lid and the base.

To this end, the case according to the invention is characterized in that, at the hinge of the case, the base has at least one flexible tongue and the lid, facing the tongue, has at least one rigid protuberance such that, during closure of the case, the protuberance of the lid comes into abutment against the flexible tongue of the base.

Preferably, the flexible tongues and the protuberances are two each respectively on the base and the lid of the case The flexible tongues constituted by an elastic material are subjected to pressure exerted by the protuberances. Because of this, the flexible tongues undergo deformation under the influence of the pressure of the protuberances, permitting these latter to be disposed in the space freed by the deformation of the tongues and, as a result, closure of the lid on the base of the case.

However, the elasticity of the material constituting the tongues is carefully limited such that the tongues at one point will no longer deform and will block the closure of the lid on the base, thereby creating the desired small gap, Preferably, the protuberances provided on the cover are of one piece therewith and are preferably in the form of bosses.

The tongues of elastic material can preferably be made of one piece with the base.

BRIEF DESCRIPTION OF THE DRAWINGS

The invention will be better understood from a reading of the following description with reference to the accompanying drawings, in which.

DETAILED DESCRIPTION OF THE DRAWINGS

Figure 1:
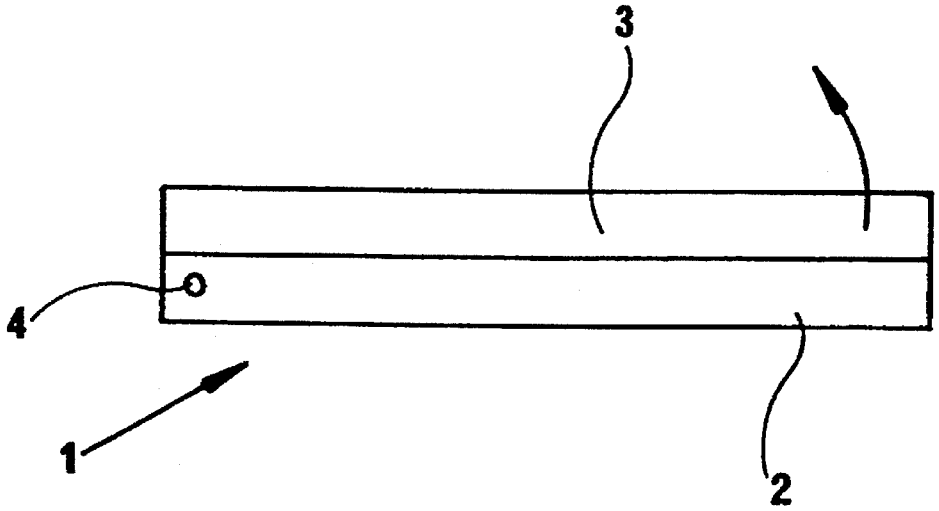
FIG. 1 is a schematic side elevational view of a flat case according to one embodiment of the invention.
Figure 2:
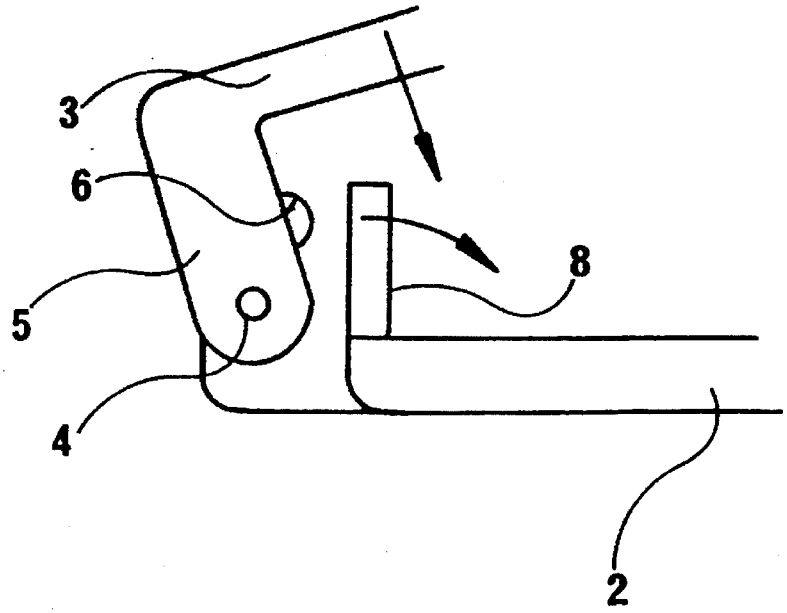
FIG. 2 is a cross sectional view of the hinge of the case of FIG. 1.
Figure 3:
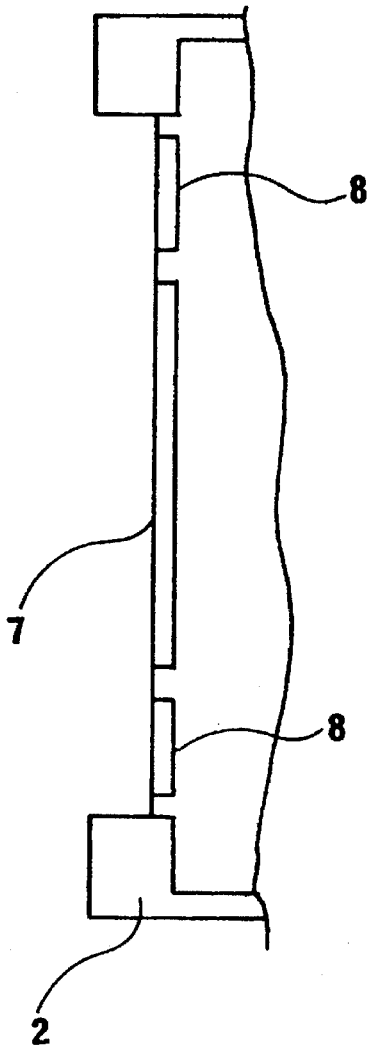
FIG. 3 is a schematic view from above of the base of the case of FIG. 1
Figure 4:
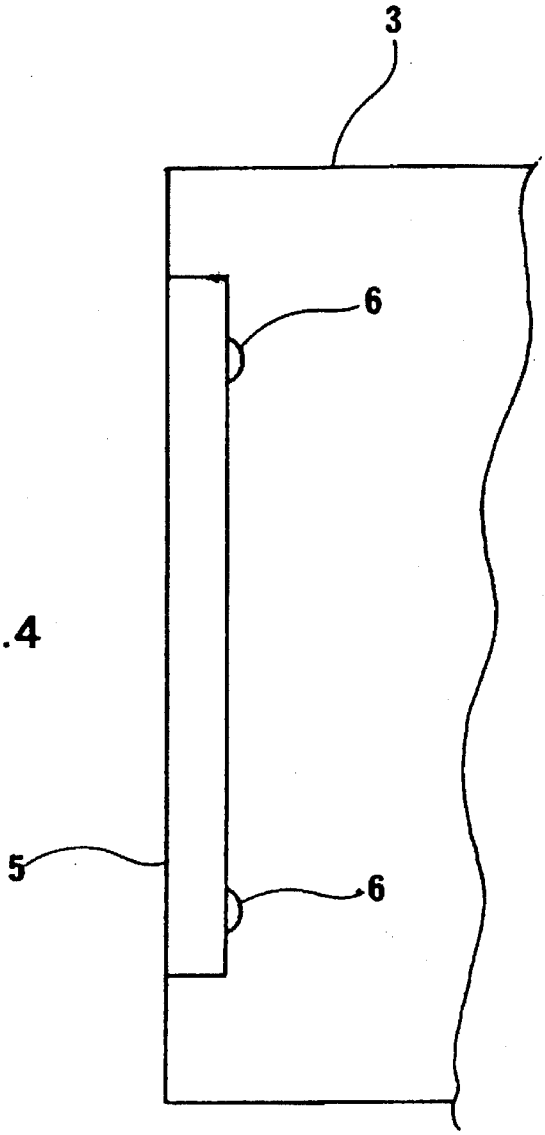
FIG. 4 is a schematic view from below of the lid of the case of FIG. 1.

A case 1 of flat shape is constituted by a base 2 on which is hinged a lid 3 about an axis of articulation 4 forming a hinge.

The portion 5 of the edge of the lid 3 which is hinged to the base 2 has preferably two protuberances in the form of bosses 6. These bosses 6 are made of one piece with the lid 3, for example during molding of the latter, The edge 7 of the base 2, where the hinge is located, has a recess in which is disposed the portion 5 of the lid 3. The edge of the base 2 has a reduced thickness and tongues 8 facing the bosses 6 are provided by cutting the edge of the base 2. In this way, during closure of the case 1, the bosses come into abutment against the tongues 8 which are partially cut away from the rest of the edge of base 2.

The tongues 8 deform under the pressure exerted by the bosses 6 during lowering of the lid 3 onto the base 2 of the case 1. The deformation undergone by the tongues 8 provides a free space which the bosses 6 can occupy, thereby permitting closure of the case 1. The elasticity of the material constituting the tongues is however limited and the deformation of the tongues 8 preferably stops when only a small gap between the lid 3 and the base 2 exists on the side of the case 1 opposite the hinge.

In the illustrated example, it is therefore possible to create a small gap between the lid 3 and the base 2 to the extent to which the tongues 8 permit a deformation connected to the pressure exerted by the bosses 6 which come into abutment during closure of the case 1, this deformation being however limited.

I claim:

1. Case for cosmetic products comprising a base and a lid hinged on one edge of said base at an axis of articulation and having a hinged closure, said base having adjacent the hinge of the case at least one relatively flexible tongue of limited elasticity being made of one piece construction with the base, said base extending in a longitudinal plane and said tongue (a) extending away from said base toward said lid at a first angle relative to said longitudinal plane when said lid is in an open mode relative to said base and (b) extending away from said hinged closure at a second angle relative to said base when said lid is in a closed mode relative to said base, said first angle being greater than said second angle, said lid having a top and a rear extending from said top toward said base, said rear having, facing said at least one tongue, at least one relatively rigid protuberance disposed between the top and said axis of articulation such that, during said closed mode, said at least one protuberance on the lid will come into abutment against said at least one tongue of the base resiliently urging said tongue from said first angle to said second angle, and said at least one rigid protuberance being made of one piece construction with the lid.

2. Case according to claim 1, wherein the lid has two protuberances and the base has two corresponding flexible tongues.

3. Case according to claim 2, wherein the protuberances are present in the form of bosses.

4. Case according to claim 3, wherein an edge of the base adjacent to the hinge has a recess for accommodating a portion of the lid, said edge having a reduced thickness, and said tongues being formed by partially cutting said edge of the base.

5. Case according to claim 1, wherein the elasticity of said at least one tongue is so limited such that after closing of the case, a small gap is formed between the lid and the bottom, said gap adapted to accommodate insertion of a fingernail for re-opening the case.

* * * * *